United States Patent [19]

Curtis et al.

[11] 4,123,917

[45] Nov. 7, 1978

[54] PRODUCE COOLER

[75] Inventors: Richard E. Curtis, Pleasanton; Robert H. Dench, Monte Sereno; Victor J. Dervin, Cupertino, all of Calif.

[73] Assignee: NPI Corporation, Burlingame, Calif.

[21] Appl. No.: 823,394

[22] Filed: Aug. 10, 1977

[51] Int. Cl.[2] ..... F25D 17/04; F26B 7/00

[52] U.S. Cl. ..... 62/309; 34/20

[58] Field of Search ..... 62/309, 310; 261/DIG. 43; 34/20

[56] References Cited

U.S. PATENT DOCUMENTS

| | | | |
|---|---|---|---|
| Re. 17,998 | 3/1931 | Fleisher | 62/309 |
| 2,044,352 | 6/1936 | Evans | 62/309 |
| 2,160,389 | 5/1939 | Palmer | 62/309 |
| 2,389,267 | 11/1945 | Matthei | 62/309 |
| 2,541,861 | 2/1951 | Chambers | 62/309 |
| 2,655,795 | 10/1953 | Dyer | 62/309 |

*Primary Examiner*—Lloyd L. King
*Attorney, Agent, or Firm*—Lothrop & West

[57] ABSTRACT

A produce cooler is for use with produce disposed in an enclosure. A vertically extending cooling compartment is located adjacent the enclosure. Within the cooling compartment is a horizontally extending heat exchanger substantially above the bottom of the compartment and well below the top thereof. A demister also extends across the cooling compartment below the top of it and sufficiently above the heat exchanger to leave an intervening chamber. There is a plenum between the produce enclosure and the cooling compartment in communication with produce in the compartment and in communication with the cooling compartment. A fan circulates air from the produce in the compartment through the plenum and into the bottom of the cooling compartment so that the air is made to rise upwardly therethrough and return from the top thereof to the produce in the cooling compartment.

The heat exchanger comprises a series of superposed, generally horizontal plates of expanded metal held apart by spacers and subject to a cold water spray from spray nozzles. The spray falls through the heat exchanger and onto the floor of the cooling compartment, from which the water discharges into a sump and flows over a cooling coil, thus having its temperature reduced. The cooled water collects in the bottom of the sump and is restored by a pump to the spray nozzles. The air flowing upwardly interchanges heat with the water droplets falling downwardly. The rising air entrains some mist and in going upwardly through the demister loses water droplets and emerges as cool, dry air to flow in heat exchanging relationship with the produce, to withdraw heat therefrom and then to recirculate.

4 Claims, 2 Drawing Figures

PRODUCE COOLER

BRIEF SUMMARY OF THE INVENTION

To cool and cleanse produce which has been received, often directly from the field and with some field heat in it, or in general to cool and cleanse virtually any produce, even if the produce is packed in cartons on pallets, there is provided a cooling compartment alongside a produce enclosure. The cooling compartment contains a heat exchanger for raining cold water down through an upwardly travelling current of air withdrawn from the vicinity of the produce and induced to flow by a fan. The falling water not only cools the upwardly flowing air, but likewise washes various contaminants therefrom such as pesticides or incidental dust and similar detritus that might be on the produce. The rising air, with water entrained therewith, goes through a demister located across the cooling compartment so that the water is substantially all extracted therefrom. The extracted water falls as droplets down through the heat exchanger and onto the floor of the compartment. The upwardly flowing air, having been cooled and washed, is restored to the produce enclosure and again travels through the vicinity of the produce. If the produce is in cartons, the cartons may be somewhat absorbent and themselves extract some residual moisture from the circulating air, thus tending to keep the produce moist and fresh. Water from the bottom of the cooling compartment is sent into a sump over a cooling coil so that absorbed heat is withdrawn and the resulting cold water is recirculated to the nozzles.

DETAILED DESCRIPTION

Figures 1, 2:
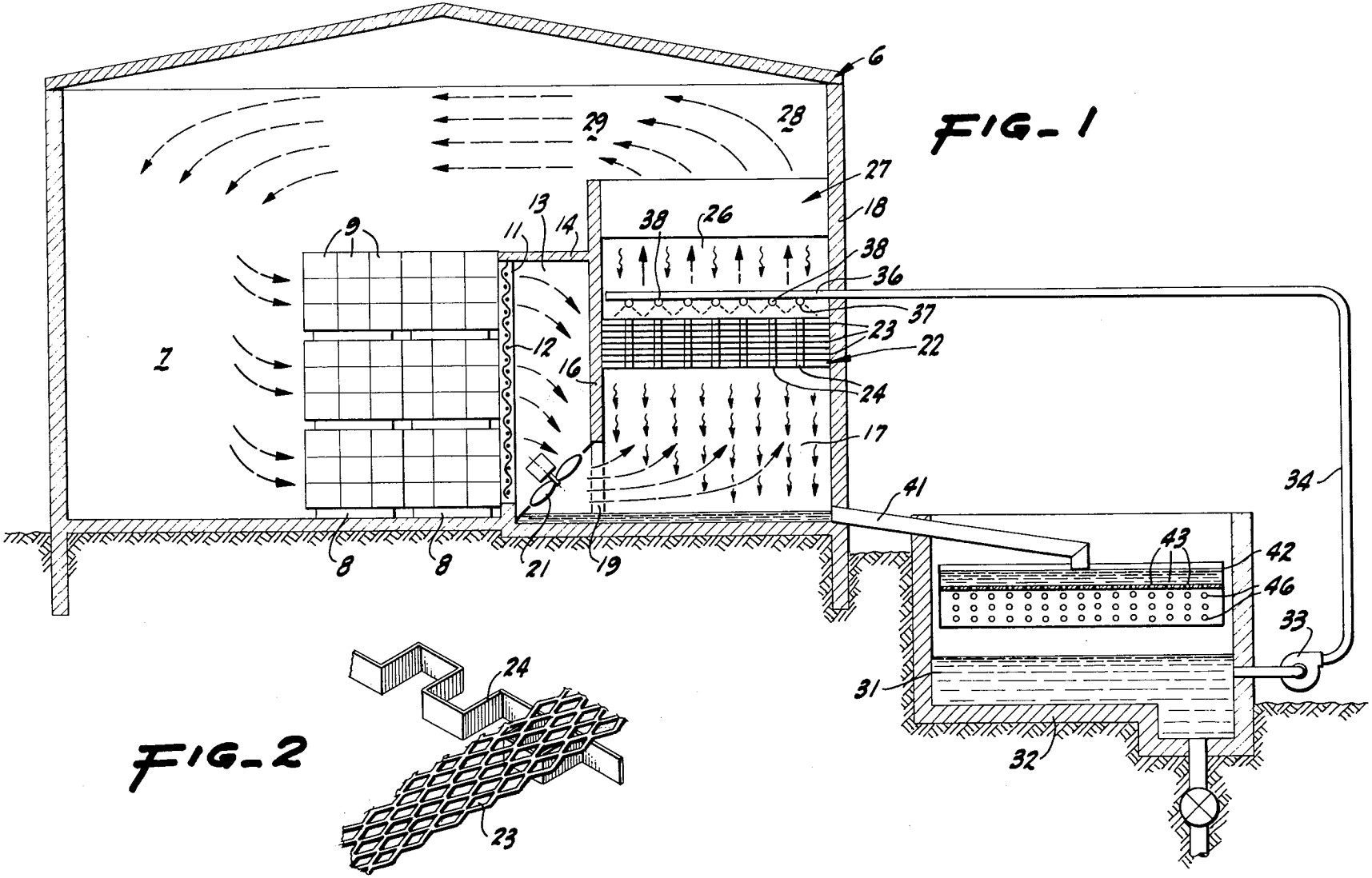
FIG. 1 is a diagram generally in vertical cross-section through a produce cooler constructed pursuant to the invention.
FIG. 2 is an isometric view, portions being broken away, of some of the expanded metal plates and spacers utilized in the heat exchanger.

In a typical installation in an area wherein produce is readily assembled, there is provided an enclosure 6 in the form of a building containing a storage room 7. Within the building there is provided a location for the storage of a number of superposed pallets 8, for example, on which are stacked containers or paper cartons 9 or the like for containing the items of produce. Usually the cartons are somewhat air pervious and the pallets 8 serve as spacers, so that there is easy and free air circulation around and through the produce in the cartons and on the pallets.

Pallets supporting produce are stacked alongside a wall 11 arranged with openings and baffles, usually about thirty percent openwork, to serve as a guide and director for a controlled air flow path through the stacked produce. The air-directing arrangement is diagrammatically represented by a screen 12 and forms one wall of a plenum 13 closed at the top by a ceiling 14. The plenum is partly open on one side adjacent the produce but is closed on the other side by a partition 16 extending vertically to separate the plenum 13 from a cooling compartment 17 extending between the partition 16 and an outer wall 18 of the building 6. The partition 16 does not extend entirely to the floor of the building and so leaves a lower opening 19 affording communication between the plenum and the cooling compartment. Interposed between the two compartments 13 and 17 is a power operated air circulating fan 21. This withdraws air from the vicinity of the produce, pulls it inwardly and downwardly through the plenum and discharges the air through the opening 19 in a generally horizontal and upward fashion into the cooling compartment 17. The air in the compartment 17 rises and goes through a heat exchanger 22 extending entirely across the compartment and spaced a substantial distance above the floor thereof and also a substantial distance below the top thereof.

The heat exchanger in detail preferably comprises a number of plates 23 conveniently of expanded metal or other openwork arrangement to afford an extended surface. The individual plates 23 are stacked one above the other on intervening, sinuous spacer strips 24 so that there can be circulation between the individual plates 23. Air travelling upwardly through the heat exchanger enters a chamber 26. This is defined not only by the walls 16 and 18 and by the heat exchanger 22 at the bottom, but also by a demister 27 extending entirely across the cooling compartment 17 and below the upper end thereof. The demister is about at the top of the partition 16, so that there is communication between a space 28 above the demister and through an opening 29 back into the produce enclosure 7. Air from the demister can again circulate through the produce therein.

In order to effectuate a heat exchanging and cooling action, there is provided a cold water supply 31 in the bottom of a sump 32. The cold water is withdrawn by a pump 33 discharging through a line 34 into a manifold 36 having a number of spray nozzles 37 spaced apart along the length thereof. The nozzles also are spaced apart longitudinally of pipes 38 projecting from the manifold and extending from one end to the other of the cooling compartment.

As the air travels upwardly through the heat exchanger and through the intestices in the expanded metal plates 23, water spray or droplets from the nozzles 37 rain downwardly thereover, dropping from one plate 23 to the next and intermingling thoroughly with the up-travelling air. Heat in the air is given up to the falling water. In addition, the water tends to wash out and remove from the ascending air particles of dust, dirt, insecticides or the like derived from the produce.

Water which falls down through the heat exchanger gathers on the floor of the cooling compartment and then travels therefrom through a duct 41 leading to a distributing pan 42 in the upper portion of the sump 32. The pan has a number of bottom apertures 43 therein, so that the returned water drips by gravity downwardly onto the refrigeration pipes 46 constituting the heat exchange surface of a refrigerated cooling coil. The pipes contain cold refrigerant from a refrigerator (not shown) of standard construction. The relatively warm water enters the sump from the cooling compartment, and contained heat indirectly derived from the produce is then removed by the cold pipes 46. The collected liquid becomes a source 31 of cool water for recirculation.

Because of the mist content of the chamber 26 and because it is desired to circulate relatively dry air to the produce, the demister 27 is employed to remove mechanically much of the water content of the air rising above the nozzles and from the heat exchanger. The demister can be made in a number of different ways, but preferably is a commercial extended surface inclusive of rubberized, sterile, animal hair. This affords a long-lasting, inert trap for water droplets, which enlarge and fall from the demister and through the spaces in the nozzle array and through the heat exchanger. The droplets fall eventually to the floor of the cooling compartment for recirculation. There is thus discharged from the demister a stream of cooled, cleaned, dry air which again flows over the produce and extracts additional heat therefrom, the cyclic circulation continuing indefinitely until the produce is sufficiently cool and clean.

The arrangement is compact with favorable air baffling and air and liquid flow paths and with well-disposed heat exchange surfaces. The power consumption is relatively low for the amount of cooling accomplished.

We claim:

1. A produce cooler comprising an enclosure for produce; a vertically extending cooling compartment; a horizontally extending heat exchanger extending across said cooling compartment above the bottom thereof and below the top thereof; a demister extending across said cooling compartment below the top thereof and disposed above said heat exchanger to leave an intervening chamber; means for circulating air from produce in said enclosure into said cooling compartment adjacent the bottom thereof, then upwardly therein through said heat exchanger, through said chamber and said demister, and from said cooling compartment adjacent the top thereof back to said produce in said enclosure; a cooling water spray device disposed in said chamber and directed to discharge downwardly over and through said heat exchanger and onto the floor of said compartment; a sump; a cooling coil in said sump; means for conducting water from the floor of said compartment to discharge over said cooling coil into said sump; and a pump connected to withdraw water from said sump and supply said water to said cooling water spray for recirculation.

2. A device as in claim 1 in which said means for circulating air is a fan disposed between said produce enclosure and said cooling compartment.

3. A device as in claim 1 including a vertically extending plenum between said produce enclosure and said cooling compartment, said plenum being substantially open along one side to said produce enclosure and being open but only near the bottom thereof to said cooling compartment.

4. A device as in claim 1 in which said cooling water spray device is provided with openings to pass water drops falling from said demister onto said heat exchanger.

* * * * *